252-95 AU 166 EX
4/3/79 XR 4,147,650

United States Patent [19] [11] 4,147,650
Sabatelli et al. [45] Apr. 3, 1979

[54] SLURRIED DETERGENT AND METHOD

[75] Inventors: Philip M. Sabatelli, Cincinnati; Denny E. Daugherty, West Chester, both of Ohio

[73] Assignee: Chemed Corporation, Cincinnati, Ohio

[21] Appl. No.: 844,558

[22] Filed: Oct. 25, 1977

Related U.S. Application Data

[63] Continuation of Ser. No. 660,588, Feb. 23, 1976, abandoned.

[51] Int. Cl.[2] ..... C11D 7/56; C11D 7/16
[52] U.S. Cl. ..... 252/103; 252/95; 252/99; 252/135; 252/156; 134/42
[58] Field of Search ..... 252/95, 99, 135, 156, 252/103; 134/42

[56] References Cited

U.S. PATENT DOCUMENTS

| | | | |
|---|---|---|---|
| 3,491,028 | 1/1970 | Crotty et al. | 252/103 |
| 3,671,490 | 6/1972 | Sabatelli et al. | 252/103 |

*Primary Examiner*—Mayer Weinblatt
*Attorney, Agent, or Firm*—Charles L. Harness

[57] ABSTRACT

The invention disclosed provides a new improved slurry detergent and to a method of using same. The slurry detergent may be formulated with alkali metal hydroxides and/or silicates, condensed phosphates, sodium hypochlorite and sodium polyacrylate, or the like. The new improved slurry is found to have significant advantages over both liquid detergents and powder detergents in dispensing as well as in use.

2 Claims, No Drawings

SLURRIED DETERGENT AND METHOD

This is a continuation of application Ser. No. 660,588 filed Feb. 23, 1976 now abandoned.

This invention relates to a new improved slurry for use in warewashing machines as well as to a method for using same. The present slurry detergent may be formulated typically with alkali metal hydroxides and/or silicates, condensed phosphates, sodium hypochlorite and sodium polyacrylate, or the like.

It has been known in formulating machine dishwashing compositions to use various combinations of inorganic builder salts such as polyphosphates, metasilicates, and carbonates combined with caustic materials such as sodium hydroxide. When sodium orthosilicate is used as a builder salt, there is no need to add the caustic material since the orthosilicate functions as alkaline builder while supplying an alkaline value.

Granular and liquid mechanical warewashing, e.g., dishwashing, products are well known to the art. These products also have well known inherent deficiencies. For example, granular products are subject to caking in the package or in the dispensers from which they are fed into the washmachine. Bulk aids or "fillers" are included which serve no direct purpose in mechanical warewashing.

On the other hand, liquid mechanical warewashing products are limited in the amount of active ingredients, which can be dissolved in water and still provide a stable detergent system.

It has now been found that by incorporating optimum properties of both liquid and granular detergents into a single product it is possible to prepare a novel blend in slurry form. The slurry eliminates caking of detergent and resulting problems in maintaining concentration in the washmachine. It further provides improved performance over liquid products which are limited in their strength by the solubility of its ingredients. The present slurry allows use of more complex phosphates and alkaline ingredients since in a slurry no true solution need be formed. Rather, a mass of semi-fluid ingredients of relatively homogeneous nature is the only prerequisite.

Generally, the present mechanical warewashing product in slurried form contains caustic soda or potash which may be replaced completely or in part with sodium metasilicate or other alkali as a source of alkalinity, sodium tripolyphosphate, sodium hypochlorite and sodium polyacrylate. Sodium polacrylate acts synergistically with the sodium tripolyphosphate to form a homogeneous suspension in slurry form, thereby facilitating uniform and complete dispensing.

The various components used to formulate the slurry detergent composition may be combined by uniformly mixing the various additions until a substantially uniform slurry is obtained. Ordinary liquid mixing equipment having preferably high speed, high shear mixing blades are especiallay useful for slurry formation.

Although not necessarily required in the composition of the present invention, it is recognized that additional components may be added such as filler materials, antiseptic materials, sanitizing material, and the like provided these materials do not deleteriously affect formation of the composition when added to a suitable solvent such as water.

Embodiments of this invention are both useful and convenient to disperse as detergents, for example, that are used in cleaning and/or sanitizing food contact surfaces, such as kitchen ware, food processing and bottling equipment and environments and metal cleaning.

An advantage of making the present slurried product is that ordinary liquids require complete solution of the ingredients. Ordinary granular products require the use of costly fillers versus the water used in liquids. Furthermore, the optimum product uses sodium hypochlorite which is inexpensive and has not yet been successfully blended into an ordinary granular product.

Optionally, the present invention may be formulated most generally of chlorine and a water softening system.

Alkaline builders found useful herein include alkali metal hydroxides and/or silicates, or the like. In order to form a proper slurry, no more than 40% weight of either of these ingredients, taken separately or in combined total amount, may be used in the total mix. Usage of greater amounts of alkaline builders tends to lead to formation of solid mass. A minimum amount of alkaline builder forming the present composition is 2.5% by weight of the slurry ingredients, dry basis.

A source of chlorine may be sodium hypochlorite which is preferred due to its low cost and good stability. Dichloro-isocyanurate anhydrous, dihydrate or monohydrate may be used as well as chlorinated TSP or Halane, a marked product by BASF-Wyandotte for dichloro-dimethyl hydantoin without destroying the present concept. Chlorine may be eliminated and still the present slurry may be a useful detergent product.

The level of chlorine used has little effect on the formation of a slurry when employed at levels below 5% chlorine, on a dry basis by weight. Thus, the chlorine source may be in amounts of 0 to 5% by weight dry basis.

The water conditioning system may be formed of sodium tripolyphosphate or tetrasodium pyrophosphate or other complex phosphates such as sodium hexametaphosphate or other builder salts, and sodium polyacrylate or sodium polymethacrylate, as well as other polyelectrolytes as desired. Aside from water conditioning, these materials serve as binder for the slurry, forming a matrix which forms the homogeneous mass. As long as no more than 30% by weight of sodium tripolyphosphate and 5.0% by dry weight of sodium polyacrylate is used, satisfactory slurry is formed. If more is used, the mass becomes too viscous or may solidify in the mixer and prevent transfer to the shipping container. A minimum amount of water conditioner is 5% by weight tripolyphosphate and 1% by weight polyacrylate, dry weight basis.

Generally, the water conditioning system may be a water-soluble polyelectrolyte polymer having a molecular weight of from 1,000 to 15,000,000 and having repeated groups with the formula:

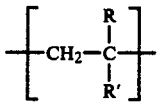

wherein R is either hydrogen or a methyl radical, and R′ is selected from the group consisting of amide radical, carboxyl radical and salts thereof.

Preferably the water soluble organic polymer of the present invention is an alkali metal salt of the polyacrylate component having a molecular weight in the range of about 1,000 to about 15,000,000 and having repeated groups with the formula:

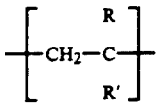

wherein R is a hydrogen radical and R' is a carboxyl group or an alkali metal salt thereof. The water soluble organic polymer is included in an amount from about 1,0 to about 20 parts by weight and preferably in an amount from about 1 to about 10 parts by weight on an anhydrous basis.

A number of additional specific examples of the water conditioning system are disclosed in U.S. Pat. No. 3,623,991, the effective parts of which are incorporated herein by reference.

Dispensing of the slurry product is effected by means of the system taught by Farison in U.S. Pat. No. 3,200,835 since it is not a true liquid.

The following formulations generally define the present the relative amounts of ingredients useful in practice of the present invention:

TABLE I

| Ingredients | Wet Basis Range | Preferred |
|---|---|---|
| Water | 15-85% | 30-50% |
| Liquid sodium or potassium hydroxide (50%) | 5-40% | 10-30% |
| Sodium metasilicate anhydrous | 0-20% | 0-10% |
| Potassium silicate (20%) 1:2.50 ratio | 0-20% | 0-10% |
| Sodium hypochlorite (15%) | 0-34% | 0-20% |
| Sodium tripolyphosphate | 5-30% | 15-25% |
| Sodium polyacrylate (20%) Avg. molecular wt (85,000-95,000) | 5-20% | 5-15% |

TABLE II

| Ingredients | Dry Basis Range | Preferred |
|---|---|---|
| Water | 40-85% | 50-70% |
| Sodium or potassium hydroxide | 2.5-20% | 5-15% |

TABLE II-continued

| Ingredients | Dry Basis Range | Preferred |
|---|---|---|
| Sodium metasilicate anhydrous | 0-20% | 0-10% |
| Potassium silicate (20%) 1:2.50 ratio | 0-8% | 0-4% |
| Sodium hypochlorite | 0-5.0% | 0-3.0% |
| Sodium tripolyphosphate | 5-30% | 15-25% |
| Sodium polyacrylate Avg. molecular wt (85,000-95,000) | 1.0-5.0% | 1.0-2.0% |

It is generally found that after application of the present slurry detergent and removal thereof from a surface, the surface is effectively sanitized and substantially cleaned.

In order to further illustrate the present invention, the following examples are given wherein all parts are by weight unless otherwise indicated:

TABLE III

| INGREDIENT | EXAMPLES EXAMPLE 1 | 2 | 3 | 4 | 5 | 6 | 7 | 8 | 9 | 10 | 11 | 12 |
|---|---|---|---|---|---|---|---|---|---|---|---|---|
| | % | % | % | % | % | % | % | % | % | % | % | % |
| Water | 35.0 | 45.0 | 46.2 | 56.2 | 20.0 | 30.0 | 35.0 | 45.0 | 46.2 | 56.2 | 20.0 | 30.0 |
| Sodium Hydroxide (50%) | 20.0 | 20.0 | 20.0 | 20.0 | 20.0 | 20.0 | — | — | — | — | — | — |
| Sodium Metasilicate Anhydrous | — | — | — | — | — | — | 10.0 | 10.0 | 10.0 | 10.0 | 10.0 | 10.0 |
| Potassium Silicate 20% $SiO_2$ 1:2.50 ratio | — | — | — | — | — | — | 10.0 | 10.0 | 10.0 | 10.0 | 10.0 | 10.0 |
| Sodium Tripolyphosphate | 20.0 | 20.0 | 20.0 | 20.0 | 20.0 | 20.0 | 20.0 | 20.0 | 20.0 | 20.0 | 20.0 | 20.0 |
| Sodium Hypochlorite (15%) | 15.0 | 15.0 | — | — | — | — | 15.0 | 15.0 | — | — | — | — |
| Sodium Dichloro-isocyanurate dihydrate | — | — | 3.8 | 3.8 | — | — | — | — | 3.8 | 3.8 | — | — |
| Chlorinated TSP | — | — | — | — | 30.0 | 30.0 | — | — | — | — | 30.0 | 30. |
| Sodium Polyacrylate Avg. Mol. Wt. 85,000-95,000 | 10.0 | — | 10.0 | — | 10.0 | — | 10.0 | — | 10.0 | — | 10.0 | — |
| Initial Available Chlorine | 1.24% | 1.33% | 1.13% | 1.20% | 1.11% | 1.20% | 1.32% | 1.32% | 1.13% | 1.17% | .53% | .60% |
| Available Chlorine after 24 hours at 120° F. | 1.15% | 1.27% | .53% | .60% | .71% | .79% | 1.20% | 1.28% | .53% | .61% | .01% | .02% |
| Available Chlorine after 96 hours at 120° F. | .92% | 1.06% | .07% | .10% | .31% | .32% | .92% | 1.09% | .07% | .09% | .00% | .00% |

In order to show polyphosphate and sodium polyacrylate:

The formulations of Examples 1 and 2 were tested by making dilutions of 0.1%, 0.2% and 0.3% in synthetic hard water of 5, 10, 15 and 20 grains and in Cincinnati tap water of 9.5 grains. These solutions were heated to 160°F. and then allowed to stand twenty-four hours to exhibit the synergistic effect of sodium tripolyphosphate and sodium polyacrylate. Sodium polyacrylate "extends" the water softening capacity of sodium tripolyphosphate beyond its theoretical value.

The formulation of Example 2 has a theoretical water softening capacity of 8-9 grains per gallon at a 0.3% concentration. Threshholding normally adds several grains of hard water tolerance to the system. Thus, the formulation of Example 2 exhibits no floc at 10 grains of hardness, but a trace of floc at 15 grains. The formulation of Example 1 exhibits some turbidity, but no floc through 20 grains of hardness.

In slurry products containing available chlorine, other suitable polyelectrolytes, such as polymethacrylate, which are chlorine compatible may be beneficially employed. The choice of polyelectrolyte is much less restrictive in slurries not containing available chlorine.

Results of using the formulation of Example 1:

TABLE IV

| DILUTIONS | WATER HARDNESS 5 GR. | 9½ GR. TAP | 10 GR. | 15 GR. | 20 GR. | TIME SPAN |
|---|---|---|---|---|---|---|
| .1% | Clear | Clear | ⅛" floc | ⅛" floc | ⅛" floc | Initial |
| | Clear | Clear | 14 mm floc | 18 mm floc | 19 mm floc | 24 hrs. |
| .2% | Clear | Clear | Clear | Moderate Turbidity | 21 mm floc | Initial |
| | Clear | Clear | Clear | Trace of floc | 21 mm floc | 24 hrs. |
| .3% | Clear | Clear | Clear | Slight Turbidity | Highly turbid | Initial |
| | Clear | Clear | Clear | Slight Turbidity | Turbid but no floc | 24 hrs. |

Results using the formulation of Example 2:

TABLE V

| DILUTIONS | WATER HARDNESS 5 GR. | 9½ GR. TAP | 10 GR. | 15 GR. | 20 GR. | TIME SPAN |
|---|---|---|---|---|---|---|
| .1% | Slight Cloud | Slight Cloud | 14 mm floc | 20 mm floc | 15 mm floc | Initial |
| | Slight Cloud | Cloudy | 14 mm floc | 17 mm floc | 15 mm floc | 24 hrs. |
| .2% | Clear | Clear | Cloudy | 14 mm floc | 25 mm floc | Initial |
| | Clear | Clear | Cloudy | 14 mm floc | 25 mm floc | 24 hrs. |
| .3% | Clear | Clear | Clear | Trace of floc | 10 mm floc | Initial |
| | Clear | Clear | Clear | Very cloudy | 10 mm floc | 24 hrs. |

The same builder system of STPP and polyacrylate exhibits a water conditioning "synergism" or "extension" Formulations of Examples 3 and 4 exhibit the same phenomenon using as a source of chlorine, sodium dichloro iso-cyanurate dihydrate.

Results using the formulation of Example 3:

TABLE VI

| DILUTIONS | WATER HARDNESS 5 GR. | 9½ GR. TAP | 10 GR. | 15 GR. | 20 GR. | TIME SPAN |
|---|---|---|---|---|---|---|
| .1% | Clear | Cloudy | 18 mm floc | 16 mm floc | 10 mm floc | Initial |
| | Clear | Cloudy | 18 mm floc | 16 mm floc | 15 mm floc | 24 hrs. |
| .2% | Clear | Clear | Cloudy | Cloudy | 21 mm floc | Initial |
| | Clear | Clear | Cloudy | Heavy cloud | 21 mm floc | 24 hrs. |
| .3% | Clear | Clear | Clear | Cloudy | Cloudy | Initial |
| | Clear | Clear | Clear | Cloudy, no ppt | Cloudy No floc | 24 hrs. |

Results using the formualation of Example 4:

TABLE VII

| DILUTIONS | WATER HARDNESS 5 GR. | 9½ GR. TAP | 10 GR. | 15 GR. | 20 GR. | TIME SPAN |
|---|---|---|---|---|---|---|
| .1% | Slight Cloud | Slight Cloud | 16 mm floc | 21 mm floc | 20 mm floc | Initial |
| | Slight Cloud | Cloudy | 16 mm floc | 21 mm floc | 20 mm floc | 24 hrs. |
| .2% | Clear | Clear | Cloudy | 18 mm floc | 25 mm floc | Initial |
| | Clear | Clear | Cloudy | 18 mm floc | 25 mm floc | 24 hrs. |
| .3% | Clear | Clear | Clear | 7 mm floc | 15 mm floc | Initial |
| | Clear | Clear | Clear | 7 mm floc | 15 mm floc | 24 hrs. |

The same base as in Tables IV and V with chlorinated TSP as the chlorine source exhibits the same phenomenon in which the inclusion of sodium polyacrylate extends the water softening properties of the tripolyphosphate.

Results using the formulation of Example 5:

TABLE VIII

| DILUTIONS | WATER HARDNESS 5 GR. | 9½ GR. TAP | 10 GR. | 15 GR. | 20 GR. | TIME SPAN |
|---|---|---|---|---|---|---|
| .1% | Clear | Clear | Cloudy | Cloudy | 45 mm floc | Initial |
| | Clear | Clear | Cloudy | Cloudy | 45 mm floc | 24 hrs. |
| .2% | Clear | Clear | Slight Cloud | Cloudy | Cloudy | Initial |
| | Clear | Clear | Slight Cloud | Cloudy | Cloudy | 24 hrs. |
| .3% | Clear | Clear | Slight Cloud | Cloudy | Cloudy | Initial |
| | Clear | Clear | Slight | Cloudy | Cloudy | 24 hrs. |

TABLE VIII-continued

| | WATER HARDNESS | | | | | |
|---|---|---|---|---|---|---|
| DILUTIONS | 5 GR. | 9½ GR. TAP | 10 GR. | 15 GR. | 20 GR. | TIME SPAN |
| | | | Cloud | | | |

Results using the formulation of Example 6:

TABLE IX

| | WATER HARDNESS | | | | | |
|---|---|---|---|---|---|---|
| DILUTIONS | 5 GR. | 9½ GR. TAP | 10 GR. | 15 GR. | 20 GR. | TIME SPAN |
| .1% | Cloudy | Cloudy | 15 mm floc | 25 mm floc | 45 mm floc | Initial |
| | Cloudy | Cloudy | 15 mm floc | 25 mm floc | 45 mm floc | 24 hrs. |
| .2% | Clear | Cloudy | 7 mm floc | 25 mm floc | 40 mm floc | Initial |
| | Clear | Cloudy | 7 mm floc | 25 mm floc | 40 mm floc | 24 hrs. |
| .3% | Clear | Clear | Trace floc | 14 mm floc | 21 mm floc | Initial |
| | Clear | Clear | Trace floc | 14 mm floc | 21 mm floc | 24 hrs. |

The formulations of Examples 7 and 8 are compared versions the same builder stock, but using a blend of sodium metasilicate anhydrous and socium silicate 20%, 1:2.5 ratio to yield an aluminum safe product with a sodium hypochlorite chlorine source. Once more, the extender effect of polyacrylate on tripoly is noted.

Results using the formulation of Example 7:

TABLE X

| | WATER HARDNESS | | | | | |
|---|---|---|---|---|---|---|
| DILUTIONS | 5 GR. | 9½ GR. TAP | 10 GR. | 15 GR. | 20 GR. | TIME SPAN |
| .1% | Slight Cloud | Clear | Light floc | Moderate floc | 19 mm floc | Initial |
| | Clear | Clear | 14 mm floc | 17 mm floc | 19 mm floc | 24 hrs. |
| .2% | Clear | Clear | Cloudy | Cloudy | 21 mm floc | Initial |
| | Clear | Clear | Cloudy | Trace of floc | 21 mm floc | 24 hrs. |
| .3% | Clear | Clear | Clear | Slight cloud | Cloudy | Initial |
| | Clear | Clear | Clear | Cloudy | Trace of floc | 24 hrs. |

Results using the formulation of Example 8:

TABLE XI

| | WATER HARDNESS | | | | | |
|---|---|---|---|---|---|---|
| DILUTIONS | 5 GR. | 9½ GR. TAP | 10 GR. | 15 GR. | 20 GR. | TIME SPAN |
| .1% | Slight Cloud | Clear | Moderate Floc | 18 mm floc | 18 mm floc | Initial |
| | Slight Cloud | Slight Cloud | 14 mm floc | 18 mm floc | 18 mm floc | 24 hrs. |
| .2% | Clear | Clear | Cloudy | 17 mm floc | 25 mm floc | Initial |
| | Clear | Clear | Cloudy | 17 mm floc | 25 mm floc | 24 hrs. |
| .3% | Clear | Clear | Clear | Cloudy | 17 mm floc | Initial |
| | Clear | Clear | Clear | Trace of floc | 17 mm floc | 24 hrs. |

Products based on Examples 9 and 10 and using a silicate alkali source and a dichloro isocyanurate dihydrate chlorine source exhibits an extender effect.

Results using the formulation of Example 9:

TABLE XII

| | WATER HARDNESS | | | | | |
|---|---|---|---|---|---|---|
| DILUTIONS | 5 GR. | 9½ GR. TAP | 10 GR. | 15 GR. | 20 GR. | TIME SPAN |
| .1% | Clear | Clear | 12 mm floc | 18 mm floc | 17 mm floc | Initial |
| | Slight Cloud | Slight Cloud | 12 mm floc | 18 mm floc | 17 mm floc | 24 hrs. |
| .2% | Clear | Clear | 2 mm floc | 4 mm floc | 25 mm floc | Initial |
| | Clear | Clear | Trace of floc | Trace of floc | 25 mm floc | 24 hrs. |
| .3% | Clear | Clear | Clear | Clear | Slight floc | Initial |
| | Clear | Clear | Clear | Clear | Slight floc | 24 hrs. |

Results using the formulation of Example 10:

TABLE XIII

| | WATER HARDNESS | | | | | |
|---|---|---|---|---|---|---|
| DILUTIONS | 5 GR. | 9½ GR. TAP | 10 GR. | 15 GR. | 20 GR. | TIME SPAN |
| .1% | Slight Cloud | Cloudy | 14 mm floc | 20 mm floc | 25 mm floc | Initial |
| | Slight Cloud | Cloudy | 14 mm floc | 20 mm floc | 25 mm floc | 24 hrs. |
| | | Slight | | | | |

TABLE XIII-continued

| | WATER HARDNESS | | | | | |
|---|---|---|---|---|---|---|
| DILUTIONS | 5 GR. | 9½ GR. TAP | 10 GR. | 15 GR. | 20 GR. | TIME SPAN |
| .2% | Clear | Cloud | 10 mm floc | 15 mm floc | 20 mm floc | Initial |
| | Clear | Clear | 10 mm floc | 15 mm floc | 20 mm floc | 24 hrs. |
| .3% | Clear | Clear | Trace of floc | 7 mm floc | 9 mm floc | Initial |
| | Clear | Clear | Trace of floc | 7 mm floc | 9 mm floc | 24 hrs. |

Products based on Examples 11 and 12 and using a silicate blend as the alkali source and chlorinated TSP as the chlorine source exhibits the extender effect.

Results using the formulation of Example 11:

TABLE XIV

| | WATER HARDNESS | | | | | |
|---|---|---|---|---|---|---|
| DILUTIONS | 5 GR. | 9½ GR. TAP | 10 GR. | 15 GR. | 20 GR. | TIME SPAN |
| .1% | Clear | Clear | Cloudy | Cloudy | 45 mm floc | Initial |
| | Clear | Clear | Cloudy | Cloudy | 45 mm floc | 24 hrs. |
| .2% | Clear | Clear | Slight Cloud | Cloudy | 20 mm floc | Initial |
| | Clear | Clear | Slight Cloud | Cloudy | 20 mm floc | 24 hrs. |
| .3% | Clear | Clear | Slight Cloud | Cloudy | Very cloudy | Initial |
| | Clear | Clear | Slight Cloud | Cloudy | Very cloudy | 24 hrs. |

Results using the formulation of Example 12:

TABLE XV

| | WATER HARDNESS | | | | | |
|---|---|---|---|---|---|---|
| DILUTIONS | 5 GR. | 9½ GR. TAP | 10 GR. | 15 GR. | 20 GR. | TIME SPAN |
| .1% | Cloudy | Cloudy | 15 mm floc | 25 mm floc | 45 mm floc | Initial |
| | Cloudy | Cloudy | 15 mm floc | 25 mm floc | 45 mm floc | 24 hrs. |
| .2% | Clear | Cloudy | 7 mm floc | 25 mm floc | 40 mm floc | Initial |
| | Clear | Cloudy | 7 mm floc | 25 mm floc | 40 mm floc | 24 hrs. |
| .3% | Clear | Clear | 2 mm floc | 18 mm floc | 25 mm floc | Initial |
| | Clear | Clear | 2 mm floc | 18 mm floc | 25 mm floc | 24 hrs. |

It is understood that the foregoing detailed description is given merely by way of illustration and that many variations may be made therein without departing from this invention.

What is claimed is:

1. A slurry detergent composition consisting essentially of:

| | Solids, dry basis Wt. % |
|---|---|
| Water | 50–70 |
| Sodium or potassium hydroxide | 5–15 |
| Sodium or potassium metasilicate, anhydrous | 0–10 |
| Sodium or potassium silicate (20%), 1:2.50 ratio | 0–4 |
| Sodium hypochlorite | 0–3.0 |
| Sodium tripolyphosphate | 15–25 |
| Sodium polyacrylate, avg. mol. wt. 85,000–95,000 | 1.0–2.0 |

2. Composition according to claim 1 in which the hydroxide is sodium hydroxide, 10%; the sodium polyacrylate is 2%; and the sodium hypochlorite is 2.25%.

* * * * *